US006755314B2

(12) United States Patent
Cooper

(10) Patent No.: US 6,755,314 B2
(45) Date of Patent: Jun. 29, 2004

(54) BEVERAGE BOTTLE WITH SIDEWALL DETAIL

(75) Inventor: John A. Cooper, Philadelphia, PA (US)

(73) Assignee: Chatam International Incorporated, DE (US)

( * ) Notice: Subject to any disclaimer, the term of this patent is extended or adjusted under 35 U.S.C. 154(b) by 0 days.

(21) Appl. No.: 10/222,257

(22) Filed: Aug. 16, 2002

(65) Prior Publication Data

US 2004/0031771 A1 Feb. 19, 2004

(51) Int. Cl.[7] ..... B65D 23/12

(52) U.S. Cl. ..... 215/386; 215/383; 215/6; 206/457

(58) Field of Search ..... 215/379, 382, 215/395, 6, 386, 12.1, 383; 206/457; D9/307; 220/669; 63/1.12, 1.11

(56) References Cited

U.S. PATENT DOCUMENTS

| | | | | | |
|---|---|---|---|---|---|
| D24,957 | S | * | 12/1895 | Mamaux | D3/544 |
| D284,938 | S | * | 8/1986 | Jedwab et al. | D9/307 |
| 4,734,895 | A | * | 3/1988 | Grosskopf | 368/229 |
| 4,800,738 | A | * | 1/1989 | Bunz | 63/26 |
| D325,345 | S | * | 4/1992 | Holland | D9/384 |
| 5,119,350 | A | * | 6/1992 | Delacretaz et al. | 368/223 |
| D329,596 | S | * | 9/1992 | Dinand | D9/544 |
| 5,201,431 | A | * | 4/1993 | Berger et al. | 215/395 |
| 5,351,851 | A | * | 10/1994 | Powell | 215/6 X |
| 6,105,814 | A | * | 8/2000 | Chen | 215/6 X |
| 6,146,723 | A | * | 11/2000 | Arends | 428/15 |
| 6,293,034 | B1 | * | 9/2001 | Skapyak et al. | 40/310 |

FOREIGN PATENT DOCUMENTS

| | | |
|---|---|---|
| GB | 2156282 | * 10/1985 |
| GB | 2227591 | * 8/1990 |
| JP | 7285297 | * 10/1995 |
| JP | 1035197 | * 2/1998 |
| JP | 20022703 | * 1/2002 |

* cited by examiner

*Primary Examiner*—Sue A. Weaver
(74) *Attorney, Agent, or Firm*—Paul & Paul

(57) ABSTRACT

A beverage bottle is provided, with a sidewall detail representing a gemstone, in which the gemstone representation is carried by and secured to the sidewall of the bottle, either directly on the surface thereof, or in a recess thereof, with or without a setting, with the gemstone representation preferably having a plurality of facets for reflecting light outwardly of the gemstone and thereby suggesting a quality product in the bottle.

15 Claims, 10 Drawing Sheets

BEVERAGE BOTTLE WITH SIDEWALL DETAIL

BACKGROUND OF THE INVENTION

Beverage bottles for various beverages, including alcoholic beverages, have long been adorned with stickers, paintings and the like, generally for purposes of advertisement, for displaying trademarks, for displaying pictures of distilleries, wineries, etc . . . , and almost always for merchandising reasons.

SUMMARY OF INVENTION

The present invention is directed to providing a beverage bottle with a sidewall detail representing a gemstone, thereby creating a suggestion of quality associated with the beverage contained within the bottle, product differentiation and/or noticeability of the product.

The gemstone can take on various forms, but will preferable have cut surfaces to simulate or comprise facets. The gemstones can be oval, octangular, circular, rectangular (for example, representing an emerald cut), pear-shaped or the like, with or without color and faceted or non-faceted. The gemstones can be configured in any desired manner, the above examples being by way of illustration, only and not limiting.

Additionally, the gemstones can be adhered to the surface of the bottle. They can be imbedded in a recess in the wall of the bottle. They can be set in a setting, such as a band-like setting, a tiffany setting, or any other type of setting. The gemstone will preferable protrude somewhat from the exterior surface of the bottle for an enhanced three-dimensional depiction.

Accordingly, it is primary of the this invention to provide a beverage bottle having a sidewall detail representing a gemstone, wherein the gemstone is three-dimensional and is carried by the sidewall of the bottle.

It is another object of this invention to accomplish the above object, wherein the gemstone protrudes outwardly from the sidewall of the bottle, and is recessed in a recess in the sidewall of the bottle.

It is a further object of this invention to provide an optional ring-like or band-like or other setting for the gemstone.

Other objects of this invention, such as providing opaque coatings on the rear surface of the gemstone facing the bottle sidewall, providing some level of transparency to the facets of the gemstone that face outwardly from the bottle, are also aspects of this invention.

Other objects and advances of the present invention will be readily apparent from a reading of the following brief descriptions of the drawing figures, the detailed descriptions the preferred embodiments, and the appended claims.

BRIEF DESCRIPTIONS OF THE DRAWING FIGURES

Figure 2:
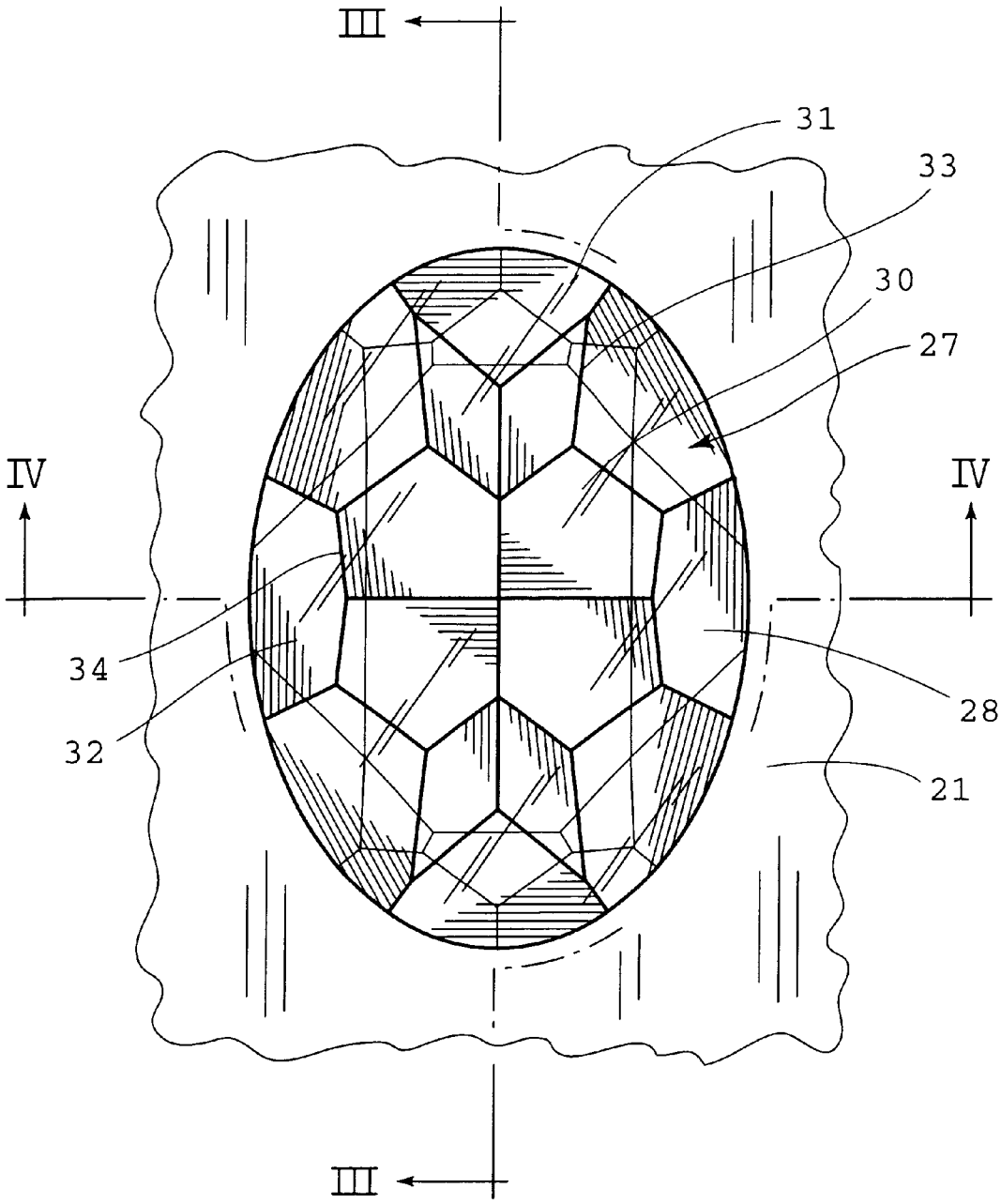
FIG. 2 is an enlarged detail of the portion of the bottle of FIG. 1 having a gemstone representation thereon.
Figure 2A:
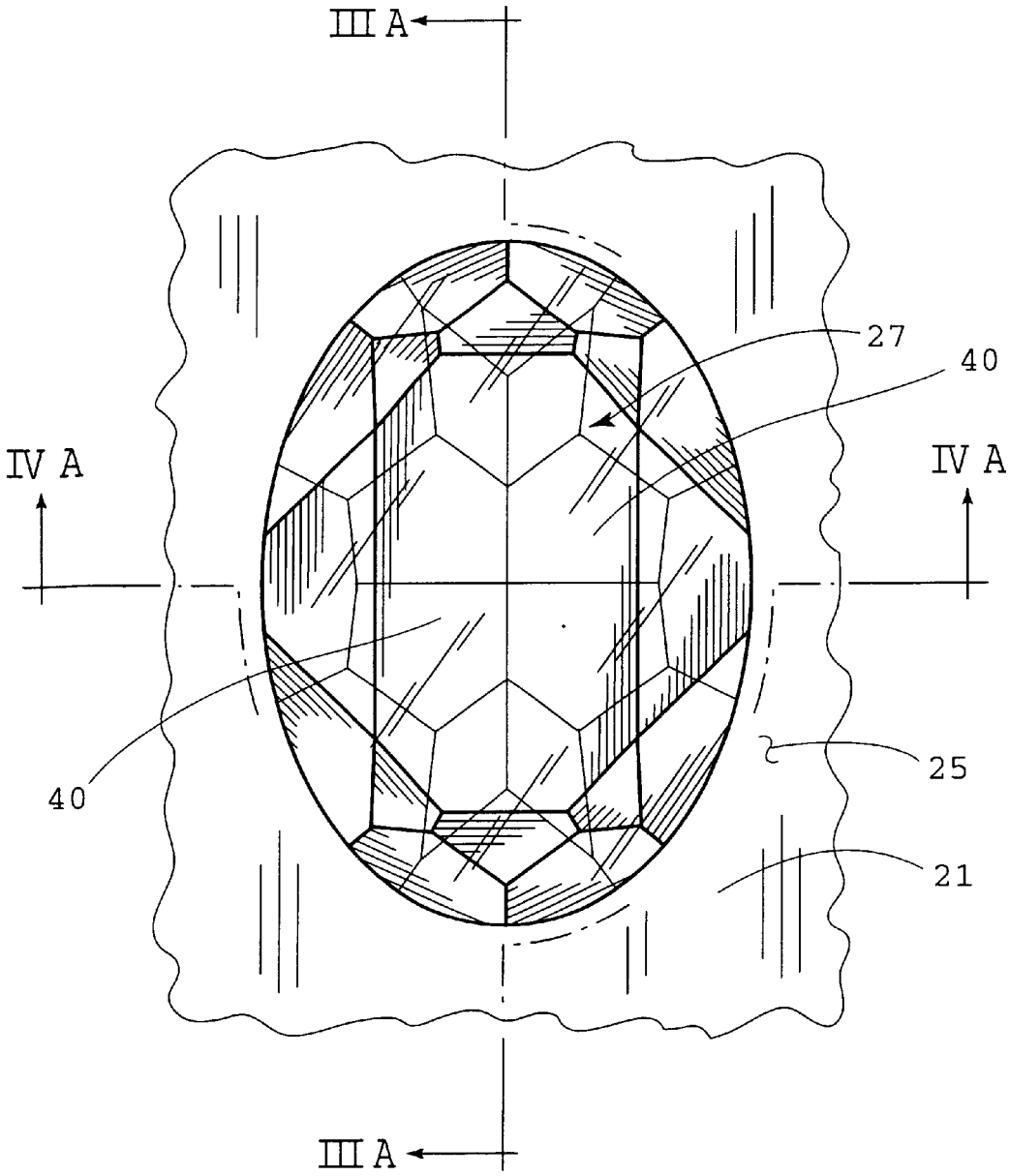
Figure 3:
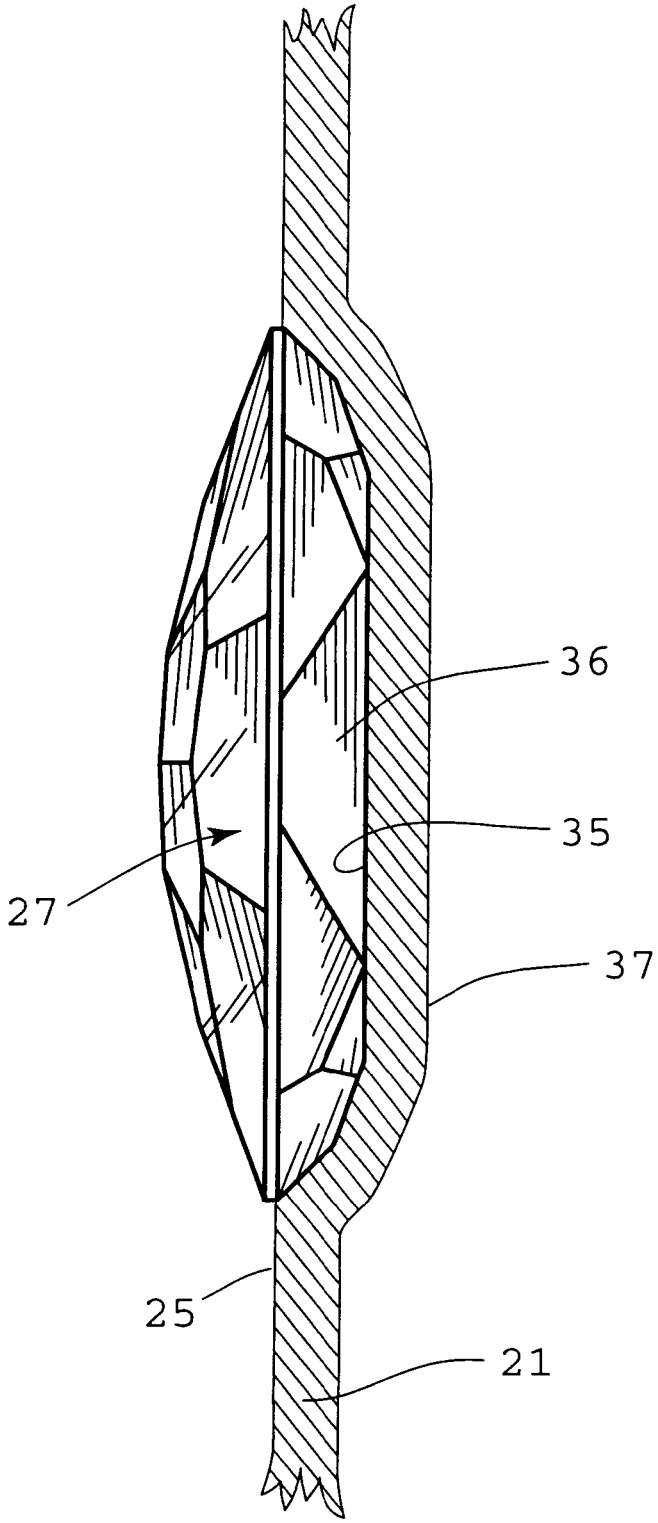
FIG. 3 is a vertical sectional view, taken through the bottle portion of FIG. 2, generally along the line III—III of FIG. 2.
Figure 3A:
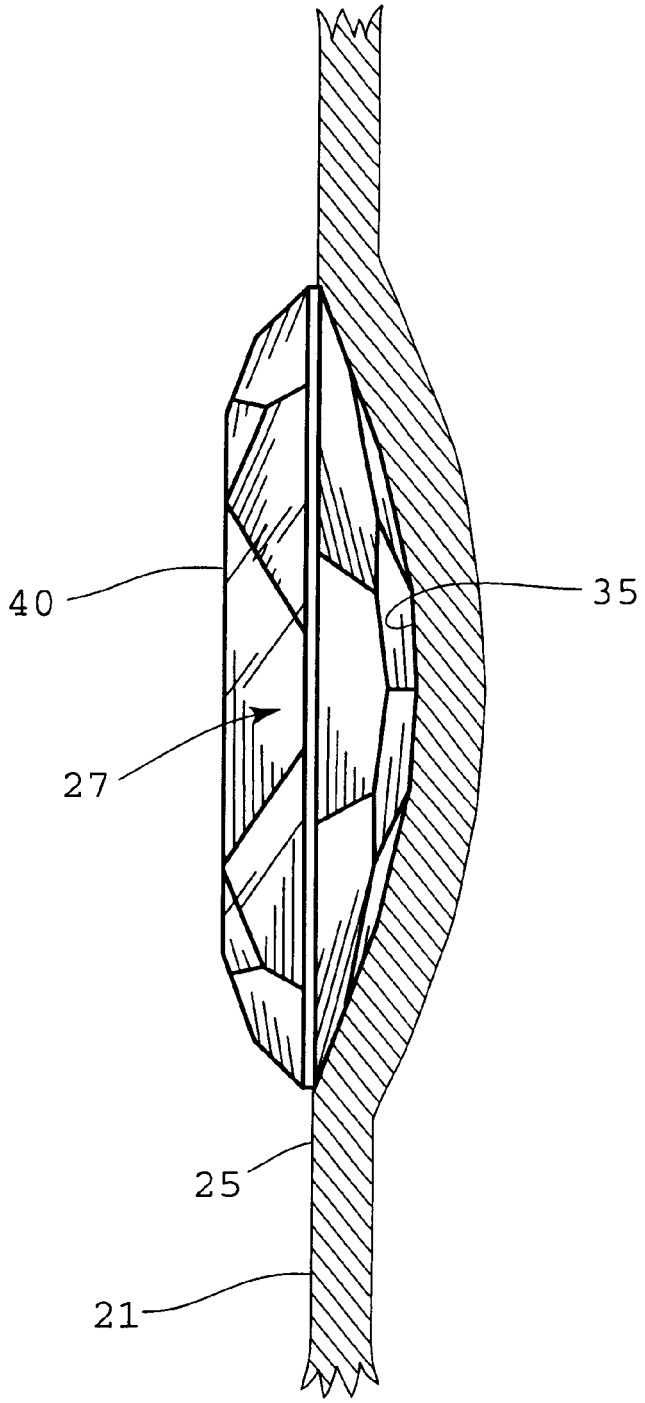
Figure 4:
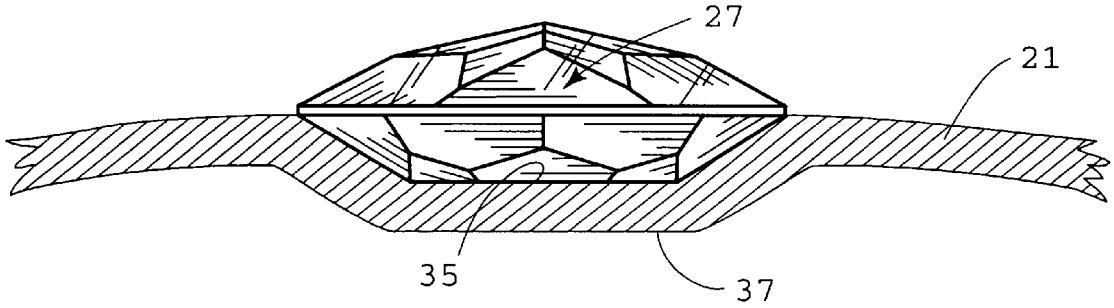
FIG. 4 is a horizontal, transverse, sectional view taken through the bottle portion of FIG. 2, generally along the line IV—IV of FIG. 2.
Figure 4A:
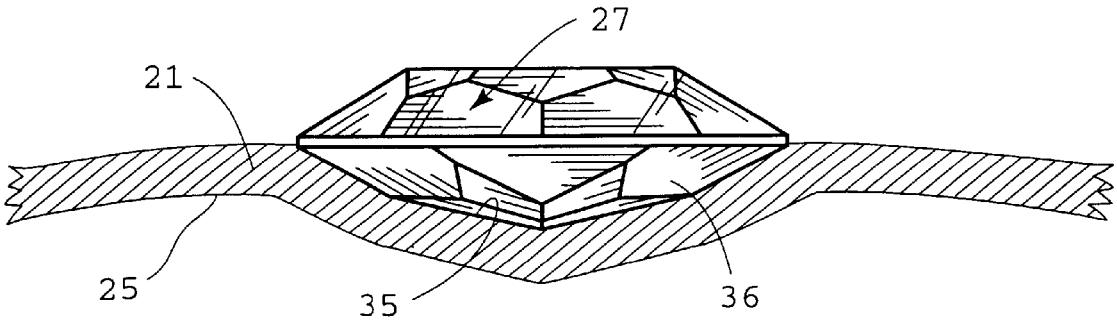

FIGS. 2*a*, 3*a* and 4*a*, are illustrations that are, respectively, similar to illustrations 2, 3 and 4 discussed above, but wherein the gemstone is reversly set relative to the gemstone illustrated in FIGS. 2, 3 and 4, such that the flatter facets face outwardly from the bottle in the illustrations of FIGS. 2*a*, 3*a* and 4*a*.

Figure 5:
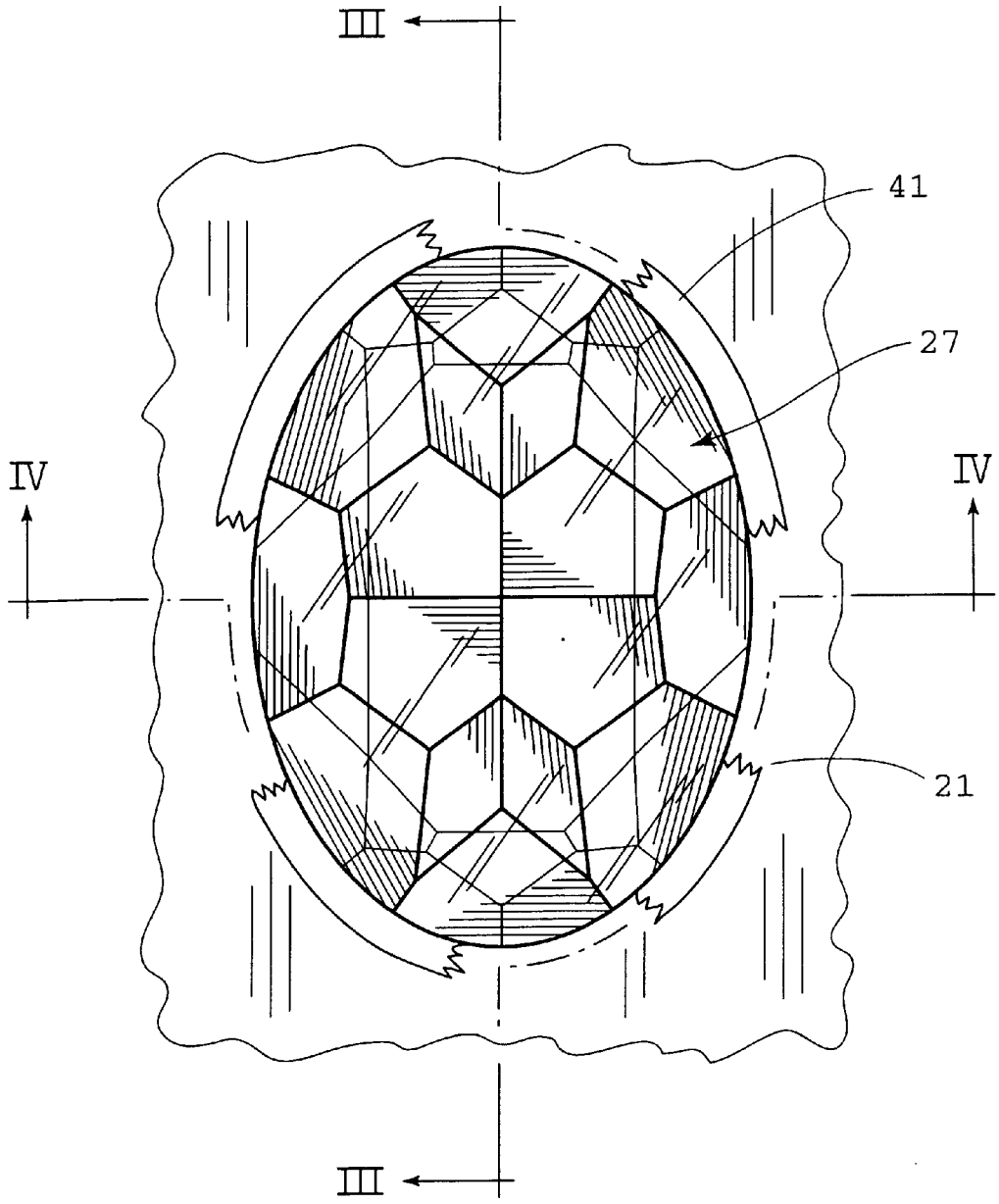
Figure 6:
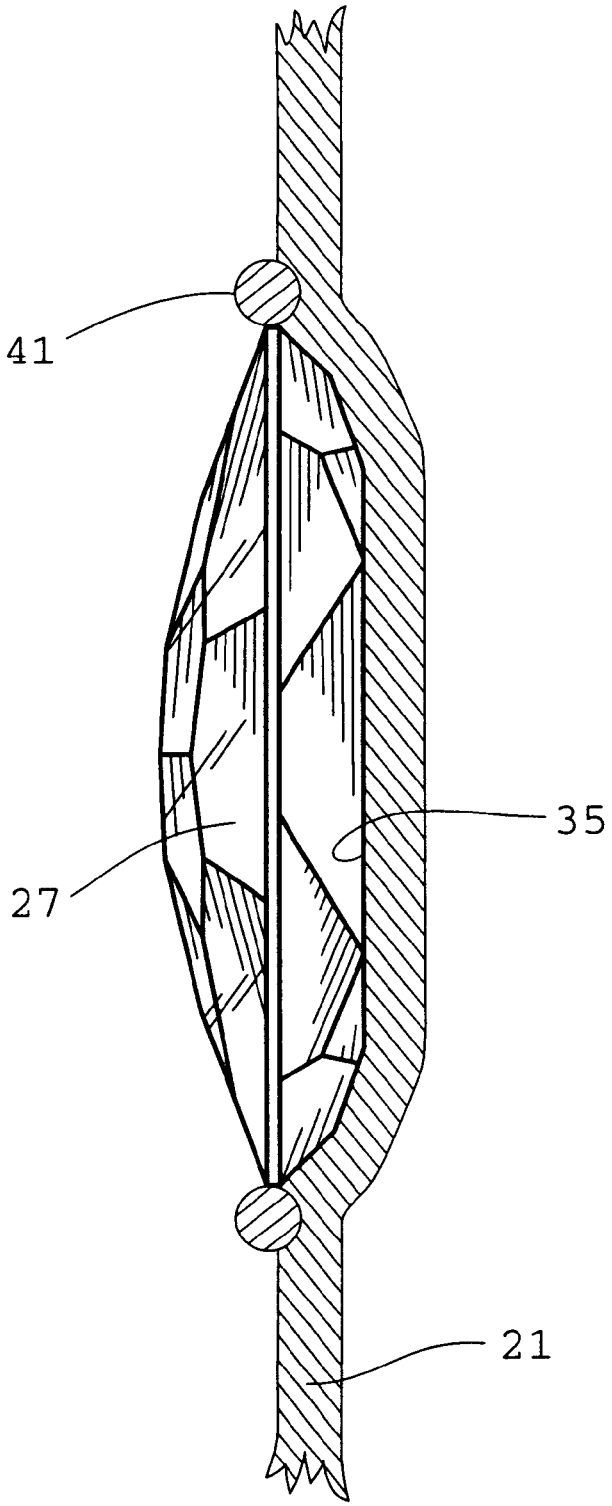
Figure 7:
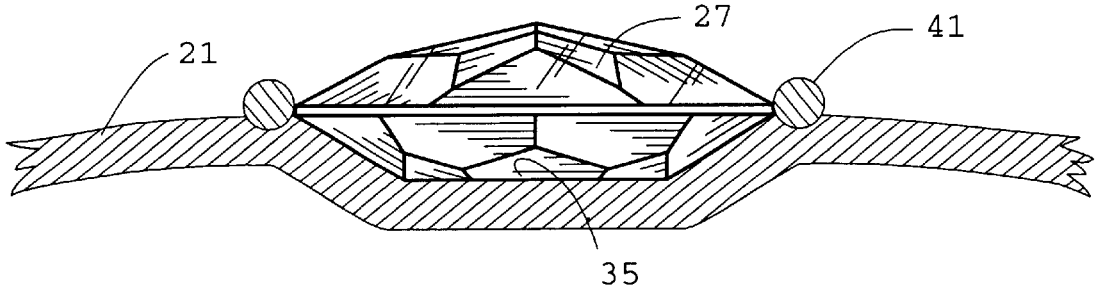

FIGS. 5, 6 and 7 are illustrations that are, respectively, similar to those of FIGS. 2, 3 and 4, but wherein the gemstone is set in an oval ring-like or band-like setting.

Figure 1A:
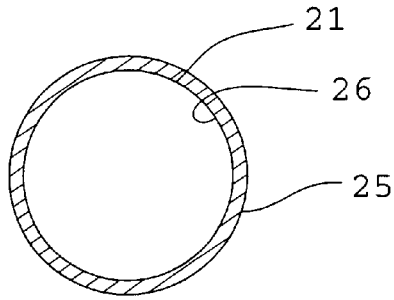
FIG. 1A is a horizontal sectional view, taken through the bottle of FIG. 1, generally along the line of IA—IA of FIG. 1.
Figure 1:
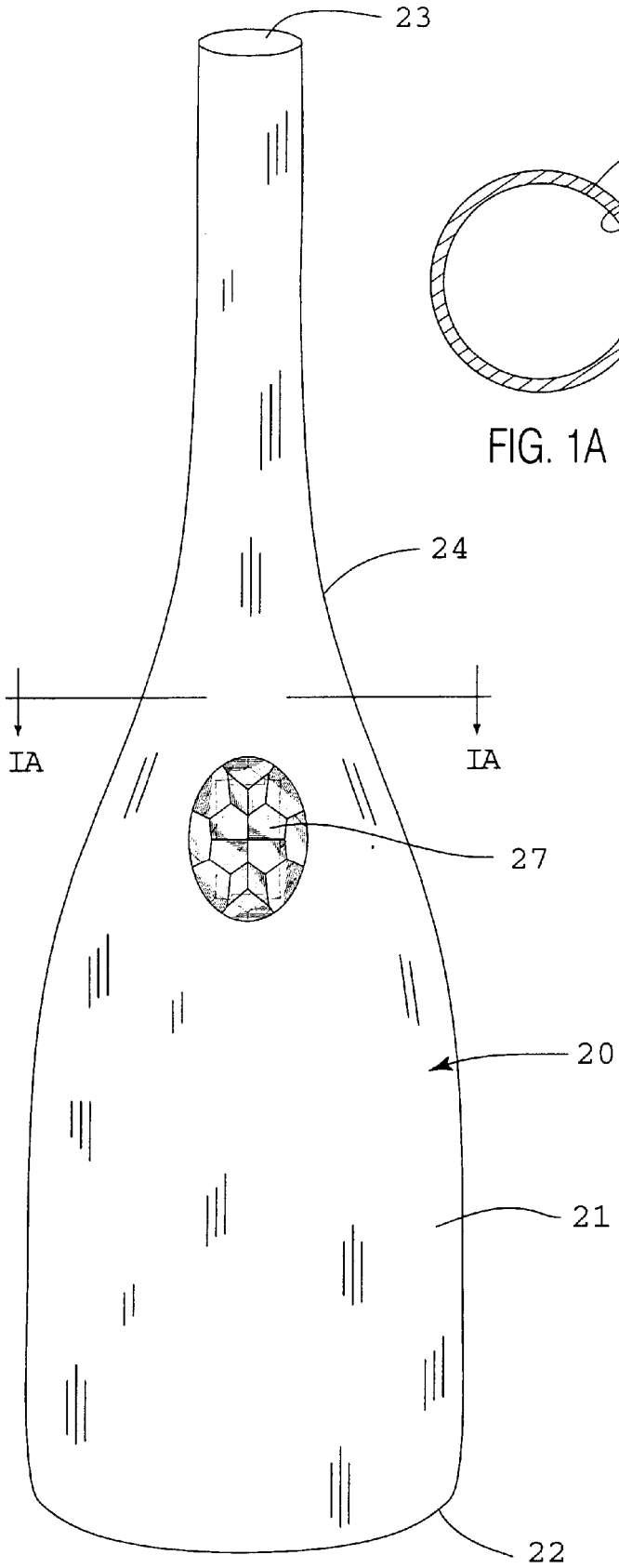
FIG. 1 is front perspective view of a beverage bottle, preferable for containing an alcoholic beverage, which bottle is provided with a sidewall detail.

DETAILED DESCRIPTIONS OF THE PREFERRED EMBODIMENTS:

Referring now to the drawings in detail, reference is first made to FIG. 1, wherein the bottle is generally designated by the numeral 20 as comprising an upstanding circular sidewall 21, having the configuration shown, extending from a bottom or base 22, up to an outlet opening 23, with the bottle sidewall 21 necking down, as at 24, to be of reduced diameter as the bottle extends toward the opening 23.

In FIG. 1*a*, the transverse cross-sectional view of the bottle is shown, such that the bottle sidewall 21 has an outside diameter 25 and an inside diameter 26.

With reference now to FIG. 2, it will be seen that the bottle sidewall configuration 21 with the gemstone representation 27 therein, in the form of an oval gemstone is shown, with the gemstone representation 27 having a plurality of facets, 28, 30, 31, 32, etc . . . The facets, as with any gem, are a plurality of surfaces, and are preferably at least somewhat transparent, with the surfaces meeting adjacent surfaces along lines 33, 34, etc . . . With the facets being at least somewhat transparent, light is reflected outwardly from the sidewall configuration 21 of the bottle, to yield a certain brilliance, suggesting a high quality product within the bottle.

With reference to FIG. 3, it will be seen that a recess 35 is provided in the exterior surface 25 of the bottle sidewall configuration, such that the rear 36 of the gemstone representation sits in the recess 35. This recess 35 is formed by an inwardly extending portion of the bottle sidewall, resulting in an inwardly protruding surface 37 thereof.

With reference to FIG. 3, it will be noted that the greater number of facets appear leftward or outwardly facing relative to the surface 25 of the bottle sidewall configuration, and that such leftwardly facing portions of the gemstone representation 27 protrude substantially outwardly of the bottle sidewall configuration 25, whereas that portion of the gemstone representation 36 that faces toward the recessed sidewall configuration 35 is flatter than the leftmost portion of the gemstone representation, for more effective seating of the gemstone representation in the recess 35. Also, the seated surface portions 36 of the gemstone representation as shown in FIG. 3, will preferably have an opaque coating thereon, to assist in reflecting light from outside the bottle and into the leftwardly facing facets for the gemstone illustration 27, such that such reflected light passes back outwardly in a leftward direction as shown in FIG. 3, to enhance the brilliant effect of the gemstone representation.

With reference to FIG. 4, it will be seen that the gemstone representation 27 is of shorter horizontal dimension than the vertical dimension illustrated in FIG. 3, consistent with an oval gemstone representation.

Referring now to FIGS. 2*a*, 3*a* and 4*a*, it will be seen that these illustrations are similar to those of FIGS. 2, 3 and 4, respectively, except that the gemstone representation of FIGS. 2*a*, 3*a* and 4*a* are such that the greater number of facets face inwardly toward the recess 35, and that the flatter faceted portion 40 of the gemstone representation faces leftwardly, such that it protrudes leftwardly a lesser amount than the greater faceted side of the gemstone illustration of FIG. 3. The effect of a setting such as that of FIG. 3*a*, is that the gemstone representation protrudes leftwardly of the bottle surface 25 a lesser amount than does the gemstone representation shown if FIG. 3.

With reference now to FIGS. 5, 6 and 7, it will be seen that the gemstone 27 is arranged in a similar manner to the sidewall configuration of the bottle of FIGS. 2, 3, and 4, except that the gemstone representation of FIGS. 5–7 is mounted in a ring-like or band-like setting 41, of a matingly similar configuration to that of the gemstone representation itself; namely oval in the case of the gemstone 27. The ring-like or band-like configuration for the setting 41 may be of circular cross-section as shown in FIGS. 6 and 7, or of any other desired geometric shape. Also, the setting 41 need not be a complete oval, but could be components of an oval, or may even comprise prongs of various numbers. For example, in setting an oval as shown, the setting could comprise 6 prongs, for example, similar to a Marquis setting, having two prongs on each side, and one on top and one on bottom. In the case where the gemstone representation may be of a round configuration, for example, the setting 41 could likewise be round and ring-like or band-like, or the same could comprise a number of prong settings, for example like a four-prong setting used for setting a Brilliant gem. In the case of a pear-shaped gemstone representation, sometimes called a teardrop configuration, a matingly similarly configured ring-like or band-like member could be utilized, such that it is also pear-shaped. Alternatively, for a pear-shaped or teardrop gemstone representation, a five-prong setting may be used. Likewise, alternatively, other shaped settings can be used, where settings are desired, including but not limited to "invisible" settings that are essentially obscured from view by the gemstone representation itself, when viewed in an illustration like that of FIG. 1. A gemstone representation can or cannot include an actual gemstone, but is broader to include a representation of a gemstone that is not an actual gemstone, such as but not limited to, a molded plastic or glass representation of a gemstone.

It will be apparent from the forgoing that various other modifications may be made, in the beverage bottle of this invention, utilizing various gemstone representations and mounting arrangements, recessed or not, all within the spirit and scope of the invention as defined in the appended claims.

What is claimed is:

1. A beverage bottle with a sidewall detail representing a gemstone, comprising:

(a) a beverage bottle having a bottom above which extends a sidewall configuration having outer and inner surfaces and a bottle outlet above the sidewall configuration; and (b) a three-dimensional gemstone representation carried by and secured to the sidewall configuration, and (c) wherein the sidewall configuration of the bottle is provided with a recess therein in which the gemstone representation is seated and directly carried in said recess, and wherein said gemstone representation substantially fills the entirety of said recess.

2. The beverage bottle of claim 1, wherein the gemstone representation is of a colored gemstone representation.

3. The beverage bottle of claim 1, wherein the gemstone representation has a plurality of cut-like facets on at least one surface thereof that face(s) outwardly from the outer surface of the sidewall configuration.

4. The beverage bottle of claim 3, wherein the gemstone representation is at least somewhat transparent on at least some of the outwardly facing facets thereof.

5. The beverage bottle of claim 1, wherein the sidewall configuration is generally circular in transverse horizontal cross-section.

6. The beverage bottle of claim 1, wherein gemstone representation protrudes outwardly of the outer surface of the sidewall configuration.

7. The beverage bottle of claim 1, wherein the recess comprises an inwardly extending zone of the bottle sidewall configuration, extending inwardly of the inner surface of the bottle sidewall configuration.

8. The beverage bottle of claim 1, wherein the gemstone representation has a plurality of cut-like facets on at least one surface thereof that face(s) inwardly, toward the outer surface of the sidewall configuration.

9. The beverage bottle of claim 8, wherein the inwardly facing surface of the gemstone representation has an opaque coating thereon.

10. The beverage bottle of claim 1, wherein the gemstone representation has a plurality of cut-like facets that face both outwardly from the outer surface of, and inwardly toward the outer surface of, the sidewall configuration.

11. The beverage bottle of claim 1, wherein the gemstone representation has a plurality of cut-like facets on at least one surface thereof that face(s) outwardly from the outer surface of the sidewall configuration, wherein the recess comprises an inwardly extending zone of the bottle sidewall configuration, extending inwardly of the inner surface of the bottle sidewall configuration, and wherein the gemstone representation has a plurality of cut-like facets on at least one surface thereof that face(s) inwardly, toward the outer surface of the sidewall configuration.

12. The beverage bottle of claim 11, wherein the inwardly facing surface of the gemstone representation has an opaque coating thereon.

13. The beverage bottle of claim 12, wherein gemstone representation protrudes outwardly of the outer surface of the sidewall configuration.

14. The beverage bottle of any one of claims 1–5 or 6–13, wherein the gemstone representation has an outer periphery and is provided with a setting about its outer periphery.

15. The beverage bottle of claim 14, wherein the setting is band-like.

* * * * *